US007559184B2

(12) United States Patent
Grzonka et al.

(10) Patent No.: US 7,559,184 B2
(45) Date of Patent: Jul. 14, 2009

(54) PACKAGING MACHINE FOR TUBULAR BAGS

(75) Inventors: Holger Grzonka, Alpharetta, GA (US); Michael Kaever, Erlangen (DE); Alexander Lotze, Freital (DE)

(73) Assignee: Siemens Aktiengesellschaft, Munich (DE)

( * ) Notice: Subject to any disclaimer, the term of this patent is extended or adjusted under 35 U.S.C. 154(b) by 118 days.

(21) Appl. No.: 11/632,902

(22) PCT Filed: Jul. 25, 2005

(86) PCT No.: PCT/EP2005/053606

§ 371 (c)(1),
(2), (4) Date: Jan. 19, 2007

(87) PCT Pub. No.: WO2006/013171

PCT Pub. Date: Feb. 9, 2006

(65) Prior Publication Data

US 2007/0209320 A1 Sep. 13, 2007

(30) Foreign Application Priority Data

Jul. 29, 2004 (DE) ..... 10 2004 036 795

(51) Int. Cl.
*B65B 9/08* (2006.01)

(52) U.S. Cl. ..... 53/551; 53/451; 53/51

(58) Field of Classification Search ..... 53/51, 53/52, 451, 551; 493/19, 20, 24
See application file for complete search history.

(56) References Cited

U.S. PATENT DOCUMENTS 3,680,446 A * 8/1972 James et al. ..... 493/9
4,009,551 A 3/1977 Greenawalt et al.
4,840,012 A * 6/1989 Boeckmann ..... 53/410
5,377,474 A * 1/1995 Kovacs et al. ..... 53/64
5,485,712 A * 1/1996 Cherney et al. ..... 53/436
5,743,066 A * 4/1998 Fukuda et al. ..... 53/64
5,768,861 A * 6/1998 Slenders ..... 53/551
6,047,521 A * 4/2000 Terminella et al. ..... 53/133.4
6,314,706 B1 * 11/2001 Araki et al. ..... 53/451

(Continued)

FOREIGN PATENT DOCUMENTS

DE 2 212 936 9/1973

(Continued)

*Primary Examiner*—Hemant M Desai

(57) ABSTRACT

When viewing in the direction of material flow of a flat film web of a packaging machine for tubular bags, a film conveying device is situated behind a shaping shoulder of a packaging machine for tubular bags. The film conveying device enables the film web to be drawn off from a film delivery device and pulled over the shaping shoulder. The film web can be shaped by means of the shaping shoulder into a bag extending in the direction of material flow. When viewing in the direction of material flow, a film joining device is situated behind the shaping shoulder. This film joining device can join together opposite lying edge areas of the film web. An incorrect position of the film web perpendicular to the direction of material flow can be detected and transmitted to a control device by a sensor device located, when viewing in the direction of material flow, between the shaping shoulder and the film joining device. A tracking device can be controlled by the control device in order to counteract the incorrect position of the film web perpendicular to the direction of material flow.

8 Claims, 1 Drawing Sheet

U.S. PATENT DOCUMENTS

| | | | | |
|---|---|---|---|---|
| 6,397,557 | B1 * | 6/2002 | Bassissi et al. | 53/51 |
| 6,751,925 | B1 * | 6/2004 | Kinoshita et al. | 53/51 |
| 7,007,440 | B2 * | 3/2006 | Kinoshita et al. | 53/64 |
| 2004/0016279 | A1 | 1/2004 | Peacock et al. | |

FOREIGN PATENT DOCUMENTS

| | | | |
|---|---|---|---|
| DE | 27 06 671 | A1 | 8/1978 |
| DE | 195 16 871 | A1 | 11/1996 |
| EP | 1 167 206 | A2 | 1/2002 |
| EP | 1 195 322 | A1 | 4/2002 |
| EP | 1 253 082 | A1 | 10/2002 |
| GB | 1 373 203 | | 11/1974 |
| JP | 08337219 | A | 12/1996 |

* cited by examiner

PACKAGING MACHINE FOR TUBULAR BAGS

CROSS REFERENCE TO RELATED APPLICATIONS

This application is the US National Stage of International Application No. PCT/EP2005/053606, filed Jul. 25, 2005 and claims the benefit thereof. The International Application claims the benefits of German application No. 10 2004 036 795.7 DE filed Jul. 29, 2004, both of the applications are incorporated by reference herein in their entirety.

FIELD OF INVENTION

The present invention relates to a packaging machine for tubular bags, comprising a film feed device, a forming collar, a film transport device, a film joining device, a sensor device, a control device and a tracking device,

- wherein the film transport device is disposed downstream of the forming collar, viewed in the material flow direction of the film web,
- wherein the film web can be pulled over the forming collar by means of the film transport device,
- wherein the film web can be shaped by means of the forming collar into a tube extending in the material flow direction,
- wherein the film joining device is disposed downstream of the forming collar, viewed in the material flow direction of the film web,
- wherein opposite edge areas of the film web can be bonded to together by means of the film joining device,
- wherein a misalignment of the film web perpendicular to the material flow direction of the film web can be detected by means of the sensor device and transmitted to the control device,
- wherein the tracking device can be actuated by the control device in such a way that the tracking device counteracts the misalignment of the film web perpendicular to the material flow direction,
- wherein the sensor device is disposed between the forming collar and the film joining device, viewed in the material flow direction of the film web.

BACKGROUND OF INVENTION

A packaging machine of this kind is known, for example, from GB 1 373 203.

DE-A-195 16 871 likewise discloses a packaging machine for tubular bags, comprising a film feed device, a forming collar, a film transport device, a film joining device, a sensor device, a control device, and a tracking device. In this packaging machine the film transport device is disposed downstream of the forming collar, viewed in the material flow direction of the film web. The film web can be pulled over the forming collar by means of said film transport device. The film web can be shaped by means of the forming collar into a tube extending in the material flow direction. The film joining device is disposed downstream of the forming collar, viewed in the material flow direction of the film web. Opposite edge areas of the film web can be bonded together by means of said film joining device. Any misalignment of the film web perpendicular to the material flow direction of the film web can be detected by means of the sensor device and transmitted to the control device. The tracking device can be actuated by the control device in such a way as to counteract the misalignment of the film web perpendicular to the material flow direction.

JP-A-08 337 219 discloses an apparatus for manufacturing a cylindrical film. In this apparatus there is disposed downstream of a forming element, viewed in the material flow direction of the film material, a transport device which transports the film material. The film material can be shaped by means of the forming element into a cylindrical tube extending in the material flow direction and can be heat-sealed by means of a joining device disposed downstream of the forming element, viewed in the material flow direction. By means of a sensor device, any misalignment of the film material perpendicular to the material flow direction can be detected and communicated to a control device. The sensor device is disposed between the forming element and the joining device, viewed in the material flow direction. A tracking device can be actuated by the control device in such a way that the tracking device counteracts the misalignment of the film web perpendicular to the material flow direction. The tracking device is disposed between the forming element and the joining device, viewed in the material flow direction.

For forming a web-shaped packaging material into a tube, a film web is normally pulled over a forming collar. After the film web has been pulled over the forming collar, opposite edge areas of the film web are bonded together by means of a film joining device, thereby forming a tube. The tube is then sealed perpendicular to its longitudinal direction, filled from the top with an item to be packaged in the tubular bag and sealed again, this time above the now packaged item.

For various reasons it is possible that the film web, viewed perpendicular to the material flow direction of the film web, will become misaligned. If this is the case, the longitudinal seam of the tubular bag will not be properly produced, resulting in tubular bags that are untight or substandard because of the poor longitudinal seam. In the prior art a sensor device is therefore present by means of which the misalignment of the film web can be detected and a corresponding signal transmitted to a control device. The control device then actuates a tracking device such that it counteracts the misalignment of the film web perpendicular to the material flow direction.

Although the prior art packaging machine already works quite well, it does not yet operate completely satisfactorily. In particular, rejects or lower quality bags occasionally occur.

SUMMARY OF INVENTION

An object of the present invention consists in further refining a packaging machine of the type described in the introduction in such a way that it has a constructionally simple design and operates even more reliably, and in particular that the residual defects are reduced.

This object is achieved for a packaging machine of the type described in the introduction in that the tracking device is disposed between the forming collar and the film joining device, viewed in the material flow direction of the film web, and that the tracking device is identical with the film transport device.

The film transport device preferably has two transport elements, each acting on respective edge areas of the film web. The transport elements are in this case actuatable independently of one another by the control device.

The transport elements can be implemented e.g. as transport rollers or as continuous transport belts. They preferably have vacuum devices by means of which the film web can be held against the transport elements, as this ensures that the transport elements transport the film web particularly reliably.

If the sensor device is disposed nearer to the forming collar than to the film joining device, viewed in the material flow direction of the film web, a particularly compact and constructionally simple design is produced.

BRIEF DESCRIPTION OF THE DRAWINGS

Further advantages and details will emerge from the following description of an exemplary embodiment with reference to the accompanying schematics in which.

DETAILED DESCRIPTION OF INTENTION

Figure 1:
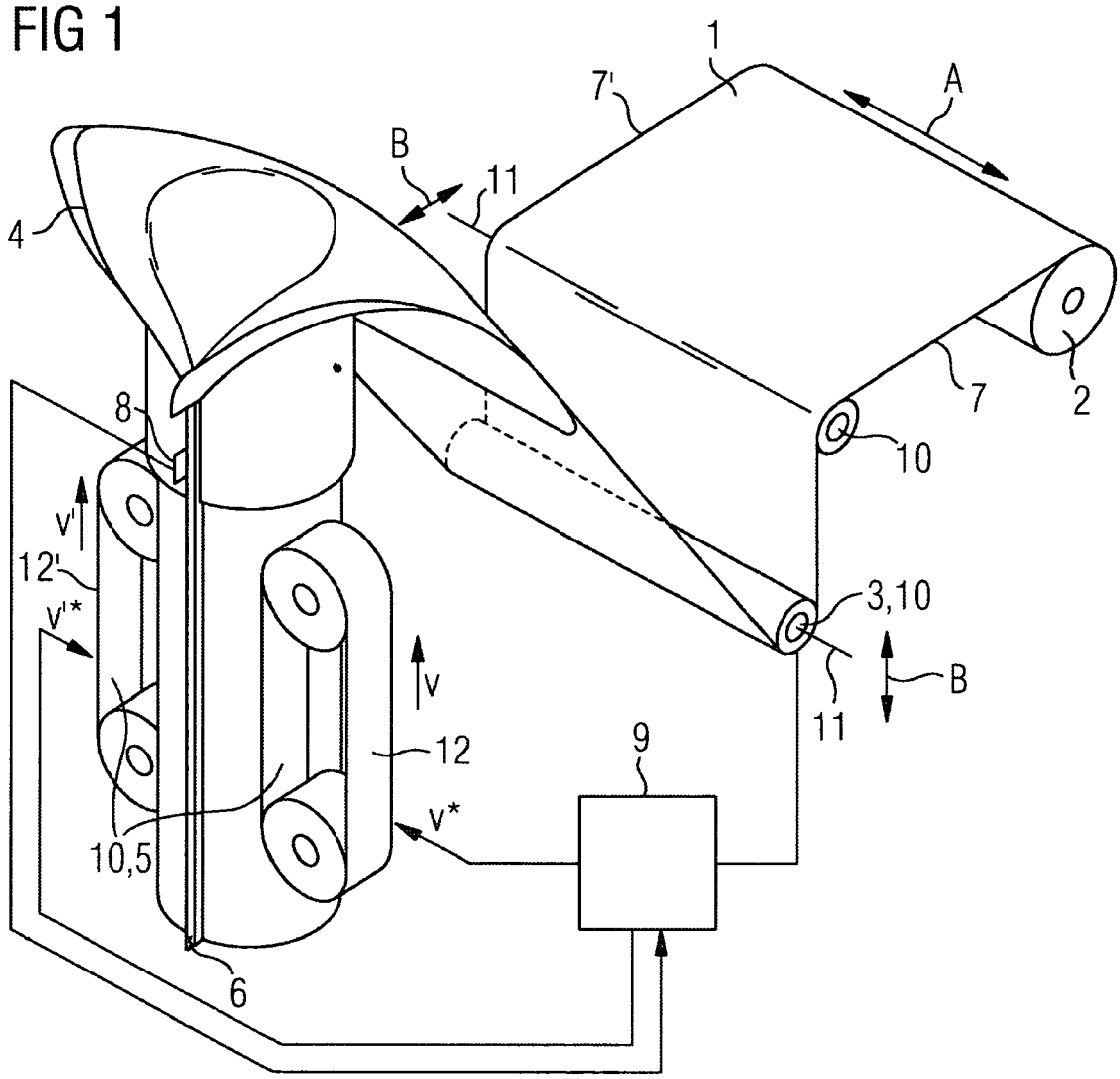
FIG. 1 shows a block diagram of a packaging machine according to the invention.

The packaging machine according to FIG. 1 is designed to shape a planar film web 1 into a tubular bag. The film web 1 is made e.g. of plastic, an aluminum foil or a composite material such as a plastic foil to which a metallic layer has been applied.

For forming the tubular bag, the packaging machine first has a film feed device 2 containing a supply of film web 1, e.g. a feed roller on which the film web 1 is initially wound. As shown in FIG. 1, the film web 1 is drawn off from the film feed device 2 by means of a front film transport device 3. However, the front film transport device 3 can be omitted. If present, it can be implemented e.g. as a rubberized drive roller 3 which is enwrapped by the film web 1 over a relatively large circumferential angle of typically at least 90°.

Viewed in the material flow direction of the film web 1, the front film transport device 3 is followed by a forming collar 4. According to the example in FIG. 1, the front conveying device 3 is therefore disposed between the film feed device 2 and the forming collar 4, viewed in the material flow direction of the film web 1.

The film web 1 is shaped by the forming collar 4 into a tube extending in the material flow direction. For this purpose the forming collar 4 is followed by a rear film transport device 5, viewed in the material flow direction of the film web 1. By means of the rear film transport device 5 the film web 1 can be pulled over the forming collar 4. If the front film transport device 3 is not present, the film web 1 is also taken off the film feed device 2 by the rear film transport device 5.

Viewed in the material flow direction of the film web 1, the forming collar 4 is also followed by a film joining device 6 by means of which edge areas 7, 7' of the film web 1 are bonded together.

Figure 2:
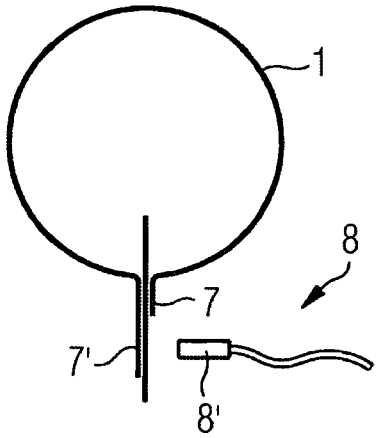
FIG. 2 shows a detail of FIG. 1.

The film joining device 6 can only bond the edge areas 7, 7' of the film web 1 together properly if the edge areas 7, 7' of the film web 1 overlap sufficiently in the vicinity of the film joining device 6. If, on the other hand, as shown in FIG. 2, the film web 1 becomes misaligned perpendicular to the material flow direction, the edge areas 7, 7' of the film web 1 are either not bonded together (joined) at all or the bonding of the edge areas 7, 7' is so weak that the tubular bag is liable to burst.

To detect such a misalignment, the packaging machine therefore has a sensor device 8, said sensor device 8 being disposed, as shown in FIG. 1, between the forming collar 4 and the film joining device 6, viewed in the material flow direction of the film web 1. The sensor device 8 is preferably disposed closer to the forming collar 4 than to the film joining device 6, viewed in the material flow direction of the film web 1.

Any misalignment detected by the sensor device 8 is transmitted by the sensor device 8 to a control device 9. The control device 9 controls among other things the film transport devices 3, 5 and—if required—also other elements of the packaging machine. In particular it also actuates a tracking device 10. The tracking device 10 tracks the film web 1 according to the drive signals from the control device 9, thus counteracting the misalignment of the film web 1 perpendicular to the material flow direction.

The sensor device 8 can employ various operating principles. In particular it can have a sensor 8' implemented as an optical, capacitive, inductive, ultrasound or touch sensor 8'.

The tracking device 10 can also be embodied in a variety of ways.

It is possible, for example, that a position of the film feed device 2 relative to the forming collar 4 can be manipulated by means of the tracking device 10. In particular it is possible, as indicated by a double arrow A in FIG. 1, that the film feed device 2 can be displaced perpendicular to the material flow direction of the film web 1 by the tracking device 10.

Alternatively it is also possible for the tracking device 10 to be disposed between the film feed device 2 and the forming collar 4, viewed in the material flow direction of the film web 1. In this case the tracking device 10 is preferably implemented as a guide roller 10 for the film web 1. It has a roller axis 11. The roller axis 11 is tiltable in this case. This is indicated by double arrows B in FIG. 1.

If the tracking device 10 is implemented as a guide roller 10 disposed between the film feed device 2 and the forming collar 4, the guide roller 10 can be implemented as a driven guide roller 10. In this case the guide roller 10 can in particular be identical with the front film transport device 3, as shown in FIG. 1.

However, it is likewise possible for the guide roller 10 to be implemented as an idler guide roller 10. For example, the tracking device 10 can in this case be implemented as a guide roller 10 disposed between the film feed device 2 and the front film transport device 3, viewed in the material flow direction of the film web 1. Alternatively, it would also be possible to dispose it between the front film transport device 3 and the forming collar 4.

It would additionally be possible to implement the guide roller 10 as a rotating frame.

Preferably, however, the tracking device 10 is disposed between the forming collar 4 and the film joining device 6, viewed in the material flow direction of the film web 1. In particular, it can be identical with the film transport device 5.

For tracking the film web 1 it is necessary to act on the edge areas 7, 7' of the film web 1 with transport speeds v, v' which are different from one another for the two edge areas 7, 7'. The rear film transport device 5 therefore has two transport elements 12, 12' each acting on respective edge areas 7, 7' of the film web 1. For this purpose the transport elements 12, 12' can be actuated by the control device 9 independently of one another. In particular differing setpoint transport speeds v*, v'* can be predefined for them by the control device 9.

The transport elements 12, 12' can alternatively be implemented as transport rollers or, as illustrated in FIG. 1, as continuous transport belts 12, 12'. In both cases the transport devices 12, 12' preferably have vacuum devices by means of which the film web 1 can be held against the transport elements 12, 12', as this increases the operating reliability of the packaging machine still further.

By means of the packaging machine according to the invention it is therefore possible to compensate misalignments of the film web 1 occurring even downstream of the forming collar 4 of the packaging machine.

The invention claimed is:

1. A packaging machine for tubular bags, comprising:

a film feed device;

a forming collar to shape a film web into a tube, a film transport device to pull the film web over the forming collar, wherein the film transport device is disposed downstream of the forming collar viewed in the material flow direction of the film web, wherein the film transport device has two transport elements each acting on respective edge areas of the film web;

a film joining device to bond opposite edge areas of the film web together, wherein the film joining device is disposed downstream of the forming collar, viewed in the material flow direction of the film web;

a sensor device to detect a misalignment of the film web perpendicular to the material flow direction of the film web, the sensor device disposed between the forming collar and the film joining device, viewed in the material flow direction of the film web;

a control device to which the misalignment is transmitted, wherein the transport elements are actuated by the control device independently of one another; and a tracking device actuated by the control device to counteract the misalignment of the film web perpendicular to the material flow direction, wherein the tracking device is disposed between the forming collar and the film joining device, viewed in the material flow direction of the film web.

2. The packaging machine as claimed in claim 1, wherein the tracking device is combined with the film transport device in one single device.

3. The packaging machine as claimed in claim 1, wherein the transport elements are transport rollers or continuous transport belts.

4. The packaging machine as claimed in claim 1, wherein the transport elements have vacuum devices to hold the film web against the transport elements.

5. The packaging machine as claimed in claim 1, wherein the transport elements have vacuum devices to hold the film web against the transport elements.

6. The packaging machine as claimed in claim 1, wherein the sensor device is disposed closer to the forming collar than to the film joining device, viewed in the material flow direction of the film web.

7. The packaging machine as claimed in claim 1, wherein the forming collar is positioned to build the tube extending in a material flow direction of the film web.

8. The packaging machine as claimed in claim 1, wherein the transport elements, each acting on respective edge areas the film web, are actuated by the control device independently of one another based upon differing setpoint transport speeds predefined for the transport elements by the control device.

* * * * *